US006648718B1

(12) United States Patent
Liu

(10) Patent No.: US 6,648,718 B1
(45) Date of Patent: Nov. 18, 2003

(54) SAFETY SPINNING TOP

(76) Inventor: Kuo-Ching Liu, 5Fl., No. 11, Alley 1, Lane 1, Sec. 1, Yunhan S. Rd., Lujou City, Taipei (TW), 247

( * ) Notice: Subject to any disclaimer, the term of this patent is extended or adjusted under 35 U.S.C. 154(b) by 0 days.

(21) Appl. No.: 10/176,671

(22) Filed: Jun. 24, 2002

(51) Int. Cl.[7] ..... A63H 1/00
(52) U.S. Cl. ..... 446/256; 446/264; 446/488
(58) Field of Search ..... 446/256, 264, 446/259, 263, 387, 388, 488, 487; D21/460

(56) References Cited

U.S. PATENT DOCUMENTS 1,785,474 A * 12/1930 Allen ..... 40/440
3,083,498 A * 4/1963 Kelley ..... 446/256
4,906,216 A * 3/1990 Abeshouse ..... 446/256
6,149,487 A * 11/2000 Peng ..... 446/114
6,196,892 B1 * 3/2001 Danneberg ..... 446/256
6,520,827 B1 * 2/2003 Liu ..... 446/256

* cited by examiner

*Primary Examiner*—Derris H. Banks
*Assistant Examiner*—Urszula M Cegielnik
(74) *Attorney, Agent, or Firm*—Rosenberg, Klein & Lee

(57) ABSTRACT

A safety spinning top is formed by stamping on a rigid and flexible round card to produce two diametrically opposite strips that could be upward bent at inner ends and then engaged with each other to provide a revolving shaft, and a conic member located between and perpendicular to the two strips and adapted to downward bent to provide a supporting and revolving center below the round card. A player may pinch at the revolving shaft and apply a twisting force to eject the spinning top, so that the spinning top spins about the pointed end of the conic member. The spinning top does not include any separate small parts that tend to be wrongly swallowed by small children, and is therefore safe for play.

3 Claims, 2 Drawing Sheets

SAFETY SPINNING TOP

FIELD OF THE INVENTION

The present invention relates to a safety spinning top, and more particularly to a safety spinning top that is formed from only one single round card.

BACKGROUND OF THE INVENTION

Most commercially available built-up spinning tops are formed by stamping with dies on a base card to produce a revolving shaft and a plurality of differently sized discs. These stamped revolving shaft and discs are then separated from the base card and built up into a spinning top. Since the built-up top before being assembled is included in a base card, it can be conveniently transported and packed along with other products for selling or used as a premium.

A disadvantage of the above-described built-up spinning top is that it includes many small parts that are easily missed after being separated from the base card and might be wrongly swallowed by small children.

SUMMARY OF THE INVENTION

A primary object of the present invention is to provide a safety spinning top that includes only one single round card. A revolving shaft of the spinning top is kept connected to the round card. The problem of easily missed parts can therefore be avoided.

Another object of the present invention is to provide a safety spinning top that includes only one single round card, which is large enough without the risk of being wrongly swallowed by small children.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
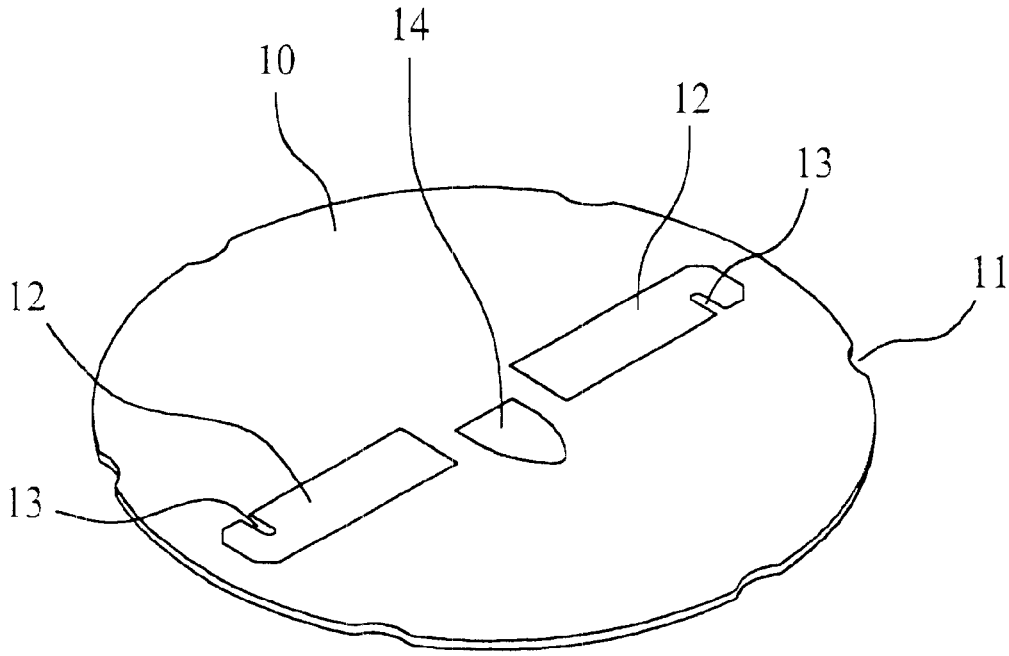
FIG. 1 is a perspective view of an embodiment of the present invention before being formed into a safety spinning top.

Please refer to FIG. 1 that shows an embodiment of the present invention before being formed into a safety spinning top. As shown, the present invention before being formed into a safety spinning top is in the form of a round card 10 made of a rigid but flexible material and having decorative dents 11 spaced along a circumference thereof. The round card 10 is stamped to produce two diametrically opposite strips 12, such that the strips 12 can be bent at their diametrically inner ends to turn upward relative to the round card 10. Two slots 13 are further provided near outer ends of the two strips 12 to face away from each other. An area of the round card 10 between the two inner ends of the two strips 12 is also stamped to produce a substantially conic member 14, a central axis of which extends in a direction perpendicular to that of the two strips 12. The conic member 14 can be bent at a flat bottom end to turn downward relative to the round card 10, so that a pointed end of the conic member 14 forms a supporting center below the round card 10. It is most preferable the flat bottom end of the conic member 14 is located at a center of gravity of the round card 10.

Figure 2:
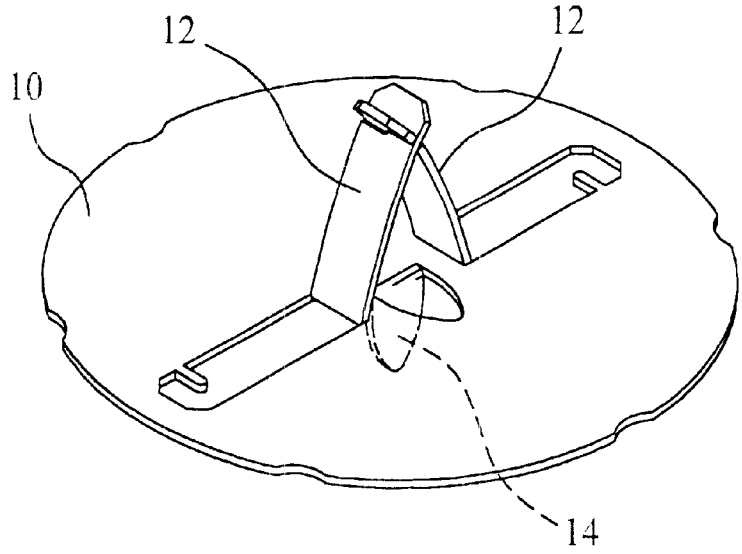
FIG. 2 is a perspective view of the embodiment of the present invention shown in FIG. 1 after being formed into a safety spinning top.

To form the safety spinning top of the present invention, first turn the two strips 12 about their inner ends for them to stand above the round card 10, and engage the two slots 13 with each other to hold the two upward turned strips 12 together, as shown in FIG. 2. The two mutually engaged strips 12 now serve as a revolving shaft of the spinning top. Thereafter, turn the conic member 14 about its flat bottom end for it to extend below the round card 10 and serve as a supporting and revolving center, as can be seen from FIG. 3.

To play the spinning top formed through the above-described steps, simply pinch the revolving shaft formed from the two engaged strips 12 with two fingers and apply a twisting force to eject the top, so that the top is supported on and spins about the pointed end of the conic member 14.

The spinning top of the present invention is characterized in that it is formed from only one single round card 10, and that the strips 12 and the conic member 14 are kept connected to the round card 10 instead of being completely separated therefrom. This design allows the present invention to be very easily assembled. It is not necessary to extend a separate revolving shaft through small holes provided on a plurality of stacked round discs forming the body of the spinning top. Since the round card 10 has dimensions large enough to prevent small children from wrongly swallowing it, the spinning top of the present invention is very safe for play.

Figure 3:
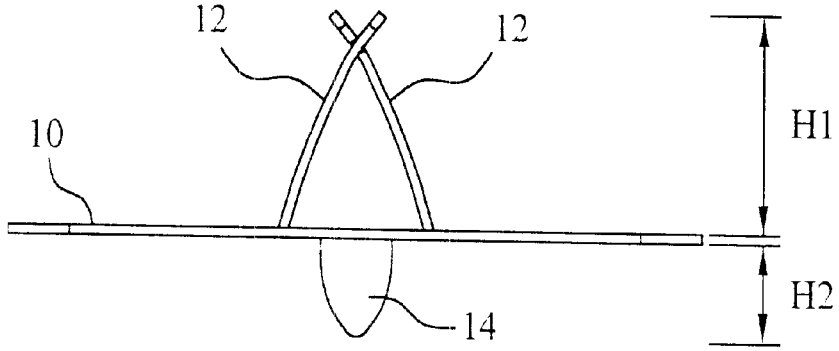
FIG. 3 is a side view of FIG. 2.

As can be seen from FIG. 3, after the safety spinning top of the present invention is completed, a height H1 defined by the two mutually engaged strips 12 relative to the round card 10 is larger than a height H2 defined by the conic member 14. This design enables the spinning top to spin more stably.

It is appreciated that the round card 10 may be changed to any other symmetrical shapes, such as an oblong card, a square card, etc., so long as the two strips 12 are symmetrically provided at two diametrically opposite positions on the card, and the conic member 14 is maintained at the center of gravity of the card 10.

The present invention has been described with a preferred embodiment thereof and it is understood that many changes and modifications in the described embodiment can be carried out without departing from the scope and the spirit of the invention as defined by the appended claims.

What is claimed is:

1. A safety spinning top, comprising:

a symmetrically shaped card made of a rigid but flexible material;

a revolving shaft being provided at an upper side of said card, and being formed by upward bending of two strips that are stamped in said card at two symmetrically and diametrically opposite positions, each of said strips having a slot formed adjacent a distal end thereof adapted for engagement with said slot of the other of said strips to hold said strips together to form said revolving shaft; and a conic member having a lower pointed end being provided at a lower side of said card, said conic member being formed by downward bending of an area of said card, said bend being located at a center of gravity of said card;

whereby when a twisting force is applied on said revolving shaft, said spinning top is ejected with said card supported on and spinning about said lower pointed end of said conic member without easily tilting over.

2. A safety spinning top comprising a symmetrically shaped member formed of a rigid but flexible material and having an upper planar side and an opposing lower planar side, said symmetrically shaped member having (a) a pair of first tabs outwardly bent to extend from said upper side, said pair of first tabs, being coupled together to define a revolving shaft, and (b) a second tab outwardly bent to extend from a location on said lower side defining a center of gravity of said symmetrically shaped member, said second tab having a lower pointed end for forming a rotational support of said safety spinning top.

3. The safety spinning top as recited in claim 2, wherein each of said pair of first tabs have a slot formed therein adjacent a distal end thereof, said pair of first tabs being coupled together by mutual engagement within said slots of each of said first tabs of a respective other one of said first tabs.

* * * * *